US009806396B2

(12) United States Patent
Huang et al.

(10) Patent No.: US 9,806,396 B2
(45) Date of Patent: Oct. 31, 2017

(54) ANTENNA, COMBINATION ANTENNA, AND MOBILE TERMINAL

(71) Applicant: Huawei Device Co., Ltd., Shenzhen (CN)

(72) Inventors: Huanqu Huang, Shenzhen (CN); Dong Yu, Shanghai (CN)

(73) Assignee: Huawei Device Co., Ltd., Shenzhen (CN)

( * ) Notice: Subject to any disclaimer, the term of this patent is extended or adjusted under 35 U.S.C. 154(b) by 109 days.

(21) Appl. No.: 14/586,693

(22) Filed: Dec. 30, 2014

(65) Prior Publication Data

US 2015/0116160 A1 Apr. 30, 2015

Related U.S. Application Data

(63) Continuation of application No. PCT/CN2013/084246, filed on Sep. 26, 2013.

(30) Foreign Application Priority Data

Sep. 28, 2012 (CN) ..... 2012 1 0370372

(51) Int. Cl.
*H01Q 1/10* (2006.01)
*H01Q 1/24* (2006.01)
*H01Q 21/28* (2006.01)

(52) U.S. Cl.
CPC ..... *H01Q 1/10* (2013.01); *H01Q 1/243* (2013.01); *H01Q 1/244* (2013.01); *H01Q 21/28* (2013.01)

(58) Field of Classification Search
CPC ..... H01Q 1/10; H01Q 1/244; H01Q 1/243
USPC ..... 343/702
See application file for complete search history.

(56) References Cited

U.S. PATENT DOCUMENTS

| | | | | |
|---|---|---|---|---|
| 4,118,708 | A * | 10/1978 | Lozar | H01Q 1/10 343/889 |
| 6,069,592 | A | 5/2000 | Wass | |
| 6,310,578 | B1 | 10/2001 | Ying | |
| 6,362,792 | B1 * | 3/2002 | Sawamura | H01Q 1/244 343/702 |
| 7,259,728 | B1 * | 8/2007 | Ostervall | H01Q 1/10 343/702 |
| 2003/0083023 | A1 * | 5/2003 | Chang | H01Q 1/244 455/90.1 |
| 2004/0090386 | A1 | 5/2004 | Shimabara et al. | |
| 2004/0217917 | A1 * | 11/2004 | Goldman | H01Q 1/244 343/901 |

(Continued)

FOREIGN PATENT DOCUMENTS

| | | | |
|---|---|---|---|
| CN | 1222258 | A | 7/1999 |
| CN | 1282451 | A | 1/2001 |

(Continued)

*Primary Examiner* — Dameon E Levi
*Assistant Examiner* — David Lotter
(74) *Attorney, Agent, or Firm* — Slater Matsil, LLP

(57) ABSTRACT

An antenna includes a telescopic antenna and an antenna jacket, where the telescopic antenna extends from a side opening and an exposed part of the telescopic antenna is configured to rotate outside the antenna jacket. The antenna and any one or more antennas of a GPS antenna, a Wi-Fi antenna, and a diversity antenna form a combination antenna. The GPS antenna and other antennas are disposed in an area adjacent to the antenna jacket.

20 Claims, 3 Drawing Sheets

(56) References Cited

U.S. PATENT DOCUMENTS

| | | | | |
|---|---|---|---|---|
| 2005/0270239 | A1* | 12/2005 | Chen | H01Q 1/244 343/702 |
| 2007/0052595 | A1* | 3/2007 | Harano | H01Q 1/244 343/702 |
| 2008/0024372 | A1* | 1/2008 | Yoon | H01Q 1/243 343/702 |
| 2009/0135083 | A1 | 5/2009 | Guo | |
| 2010/0283708 | A1 | 11/2010 | Kim et al. | |

FOREIGN PATENT DOCUMENTS

| | | | |
|---|---|---|---|
| CN | 200997442 | Y | 12/2007 |
| CN | 201112548 | Y | 9/2008 |
| CN | 101442149 | A | 5/2009 |
| CN | 101702461 | A | 5/2010 |
| CN | 102938491 | A | 2/2013 |
| EP | 0634806 | A1 | 1/1995 |
| EP | 1608085 | A2 | 12/2005 |
| JP | H07162217 | A | 6/1995 |
| JP | H11298218 | A | 10/1999 |
| JP | 2000059117 | A | 2/2000 |
| JP | 2003204215 | A | 7/2003 |
| JP | 2011061513 | A | 3/2011 |
| JP | 2011249913 | A | 12/2011 |
| KR | 20050119031 | A | 12/2005 |
| KR | 20060062861 | A | 6/2006 |
| KR | 20070029531 | A | 3/2007 |
| KR | 101166846 | B1 | 7/2012 |

* cited by examiner

ANTENNA, COMBINATION ANTENNA, AND MOBILE TERMINAL

This application is a continuation of International Application No. PCT/CN2013/084246, filed on Sep. 26, 2013, which claims priority to Chinese Patent Application No. 201210370372.4, filed on Sep. 28, 2012, both of which are hereby incorporated by reference in their entireties.

TECHNICAL FIELD

The present invention relates to communications technologies, and in particular, to an antenna, a combination antenna, and a mobile terminal that are used for communication.

BACKGROUND

With development of science and technology, a requirement for watching television by using a mobile phone or other mobile terminal products constantly increases around the world. A new wireless communications functional part that emerges accordingly is mainly a telescopic antenna. However, the telescopic antenna needs to occupy certain space of a mobile phone. In addition, based on a user's requirement for optimal experience of communication performance, a position for disposing a telescopic antenna usually conflicts with a GPS (Global Positioning System) antenna or a Wi-Fi (wireless fidelity) antenna.

To resolve this problem, when designing a mobile terminal, technical personnel consider moving the GPS antenna and the Wi-Fi antenna to other positions for arrangement, or moving the telescopic antenna to another position for placement, which, however, deprives a user of optimal performance experience. In addition, because the telescopic antenna and other antennas, such as the GPS antenna, cannot share space, a size of the mobile terminal is large. Therefore, the technical personnel still dispose these antennas together. In this disposition manner, when the telescopic antenna is extended, a surrounding metal environment of the GPS antenna and the other antennas changes, and therefore resonance frequency between the GPS antenna and the other antennas and the surrounding environment changes, and communication frequency of the GPS antenna and the other antennas deviates. Therefore, communication performance noticeably deteriorates, and the GPS antenna and the other antennas of the user even cannot work properly.

SUMMARY

Embodiments of the present invention provide an antenna, a combination antenna, and a mobile terminal, so as to improve stability of signal frequency of a user's mobile terminal and ensure good communication performance.

According to a first aspect, an embodiment of the present invention provides an antenna, including a telescopic antenna and an antenna jacket. The antenna jacket is of a hollow tube structure that has an opening at at least one end, the telescopic antenna is disposed in the antenna jacket, and the telescopic antenna is configured to slide in the antenna jacket and extend from the opening at the one end of the antenna jacket.

With reference to the first aspect, in a first possible implementation manner of the present invention, the antenna mentioned above further includes a stopper base and an antenna base. The stopper base is of a hollow tube structure, the stopper base is disposed above the antenna jacket, a gap exists between the stopper base and the antenna jacket in a length direction of the antenna jacket, and an inner diameter of the stopper base adapts to an outer diameter of the telescopic antenna, so that the telescopic antenna is configured to slide in the stopper base.

The antenna base is disposed in the antenna jacket and connected to a lower part of the telescopic antenna. The antenna base is configured to slide in the antenna jacket with the telescopic antenna. The antenna base has a ring-shaped protrusion. An outer diameter of the ring-shaped protrusion is greater than the inner diameter of the stopper base. After the telescopic antenna is extended, the ring-shaped protrusion is clamped at the gap.

According to the antenna mentioned above, the antenna jacket is of a hollow tube structure, and the stopper base and the antenna jacket are coaxially disposed.

According to the antenna mentioned above, the antenna further includes an elastic sleeve. The elastic sleeve is clamped at the gap between the stopper base and the antenna jacket, so as to restrict movement of the antenna jacket towards a direction of the stopper base.

With reference to the first aspect, in a second possible implementation manner of the present invention, the antenna jacket is of a semicylindrical structure, and the telescopic antenna extends from a side opening and an exposed part of the telescopic antenna can rotate outside the antenna jacket.

With reference to the first aspect, in a third possible implementation manner of the present invention, the antenna jacket is of a tube structure with a side open slot, and the telescopic antenna extends from a side opening and an exposed part of the telescopic antenna can rotate outside the antenna jacket.

According to a second aspect, an embodiment of the present invention provides a combination antenna, and the combination antenna includes any one or a combination of several of the following antennas: a GPS antenna, a Wi-Fi antenna, and a diversity antenna, and further includes the antenna structure according to any one of the first to the third possible implementation manners of the present invention.

Any one or more antennas of the GPS antenna, the Wi-Fi antenna, and the diversity antenna are disposed in an area adjacent to the antenna jacket.

According to a third aspect, an embodiment of the present invention provides a mobile terminal, where the terminal includes the combination antenna provided in the second aspect of the present invention, and the combination antenna is disposed in an antenna installation position on the terminal.

According to an antenna, a combination antenna, and a mobile terminal provided in the embodiments of the present invention, because an antenna jacket is disposed outside a telescopic antenna, when the telescopic antenna is drawn out, the antenna jacket still stays in an original position and does not move. For a GPS antenna and other antennas that are disposed on a terminal housing in an area adjacent to the telescopic antenna and/or attached to an outer wall of the antenna jacket by using an insulation antenna support, a surrounding metal environment does not significantly change, and the GPS antenna and the other antennas can work properly. Therefore, the telescopic antenna can be disposed with the GPS antenna and the other antennas in a centralized manner, without compromising a user's requirement for communication performance of a mobile terminal or optimal user experience.

BRIEF DESCRIPTION OF THE DRAWINGS

To describe the technical solutions in the embodiments of the present invention more clearly, the following briefly introduces the accompanying drawings required for describing the embodiments or the prior art. Apparently, the accompanying drawings in the following description show merely some embodiments of the present invention, and persons of ordinary skill in the art may still derive other drawings from these accompanying drawings without creative efforts.

DETAILED DESCRIPTION OF ILLUSTRATIVE EMBODIMENTS

To make the objectives, technical solutions, and advantages of the embodiments of the present invention clearer, the following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by persons of ordinary skill in the art based on the embodiments of the present invention without creative efforts shall fall within the protection scope of the present invention.

An embodiment of the present invention provides an antenna, where the antenna may be applied to various mobile communications terminals, to ensure stability of communication frequency of the mobile terminals. In this embodiment of the present invention, a mobile phone is used as an example, and the antenna is described in detail with reference to the accompanying drawings.

Figure 1:
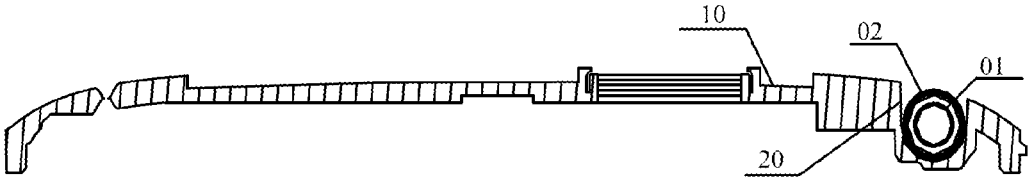
FIG. 1 is a schematic diagram of a first antenna that is disposed on a mobile terminal according to Embodiment 1 of the present invention.

FIG. 1 is a schematic diagram of a first antenna that is disposed on a mobile terminal according to Embodiment 1 of the present invention.

As shown in FIG. 1, in Embodiment 1 of the present invention, the antenna includes a telescopic antenna 01 and an antenna jacket 02, where the antenna jacket 02 is of a hollow tube structure that has an opening at at least one end, the telescopic antenna 01 is disposed in the antenna jacket 02, and the telescopic antenna 01 can slide in the antenna jacket and extend from the antenna jacket 02.

Figure 2:
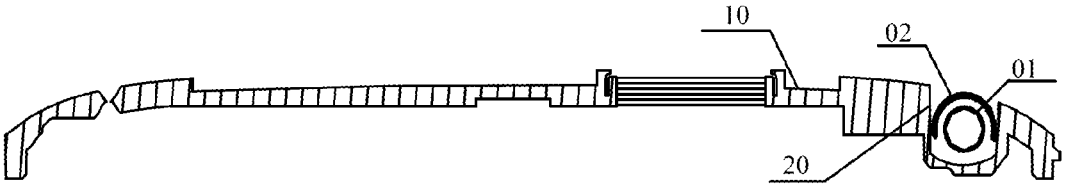
FIG. 2 is a schematic diagram of a second antenna that is disposed on a mobile terminal according to Embodiment 1 of the present invention.

The telescopic antenna 01 may be an existing conventional telescopic antenna for watching web TV, or may also be a telescopic antenna with special performance. In addition, the antenna jacket 02 disposed outside the telescopic antenna 01 may be of a cylindrical structure, or may also be of a tube structure with a side open slot. FIG. 2 is a schematic diagram of a second antenna that is disposed on a mobile terminal according to Embodiment 1 of the present invention. As shown in FIG. 2, the antenna jacket 02 may be of a tube structure with a side open slot. Specifically, the antenna jacket 02 is of a semicylindrical structure, the antenna jacket 02 partially encloses the telescopic antenna 01, and no other antenna of the terminal is disposed at a side opening of the antenna jacket 02. In addition, the antenna jacket 02 may be a metal sleeve, or a cylindrical object coated with conductive substance on the surface, or may also be directly electroplated and molded. In an actual application, a shape and a disposition manner of the telescopic antenna 01 and the antenna jacket 02 may be flexibly selected according to a requirement.

Specifically, in an actual application of the antenna, the antenna needs to be disposed on a mobile terminal, where the mobile terminal may be a mobile phone, or certainly, may also be another terminal device that receives a wireless signal. In this embodiment, the mobile phone is used as an example of the mobile terminal. As shown in FIG. 1, there is a groove 20 on a top right side (in an actual application, a position of the antenna is selected according to a requirement) of a mobile phone housing 10, the telescopic antenna 01 is disposed in the groove 20 of the mobile phone housing 10, the antenna jacket 02 is disposed outside the telescopic antenna 01, and the telescopic antenna 01 can slide in the antenna jacket 02 and extend from the opening at the one end of the antenna jacket. As shown in FIG. 1, the antenna jacket 02 is of a cylindrical structure. However, in the present invention, the antenna jacket 02 is not limited to a cylindrical shape, and may also be of a semicylindrical, a tube structure with a side open slot, or the like. In addition, the antenna jacket 02 may be a metal sleeve, or a cylindrical object coated with conductive substance on the surface, or may also be directly electroplated and molded.

Figure 3:
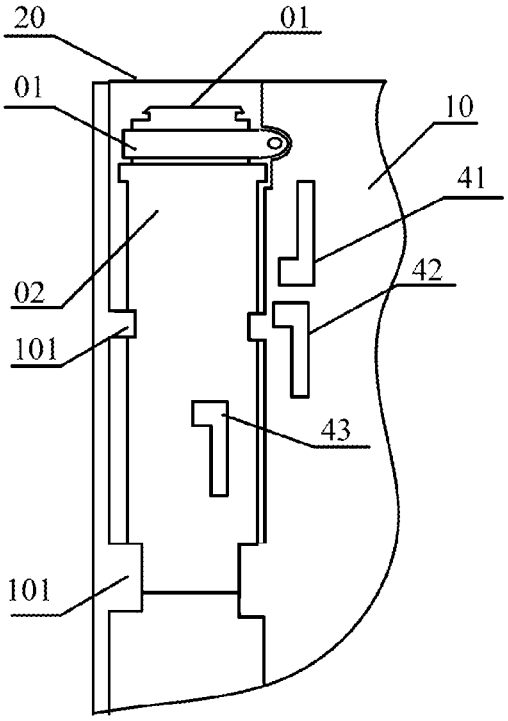
FIG. 3 is a rear view of an antenna that is disposed on a mobile terminal according to Embodiment 1 of the present invention.

FIG. 3 is a rear view of an antenna that is disposed on a mobile terminal according to Embodiment 1 of the present invention. As shown in FIG. 3, a GPS antenna 41 and a Wi-Fi antenna 42 may be disposed on the mobile phone housing 10 in an area adjacent to the telescopic antenna 01, and a diversity antenna 43 is attached to an outer wall of the antenna jacket 02 by using an insulation support (which is not shown). Positions for placing other antennas, such as the GPS antenna 41, the Wi-Fi antenna 42, and the diversity antenna 43, may be flexibly selected according to an actual requirement, that is, any one or more antennas of the other antennas, such as the GPS antenna 41, the Wi-Fi antenna 42, and the diversity antenna 43, may be disposed on the mobile phone housing 10 in the area adjacent to the telescopic antenna 01 and/or attached to the outer wall of the antenna jacket 02 by using the insulation support (which is not shown).

According to an antenna provided in Embodiment 1, because an antenna jacket is disposed outside a telescopic antenna, when the telescopic antenna is drawn out, the antenna jacket still stays in an original position and does not move. For a GPS antenna and other antennas that are disposed on a terminal housing nearby the telescopic antenna and/or attached to an outer wall of the antenna jacket by using an insulation antenna support, a surrounding metal environment does not significantly change, communication frequency of the GPS antenna and the other antennas does not deviate, and communication performance is not affected. When the telescopic antenna is drawn out, the GPS antenna and the other antennas can continue working properly.

The antenna provided in Embodiment 1 further includes a stopper base and an antenna base, where the stopper base is of a hollow tube structure, the stopper base is disposed above the antenna jacket, a gap exists between the stopper base and the antenna jacket in a length direction of the antenna jacket, and an inner diameter of the stopper base adapts to an outer diameter of the telescopic antenna, so that the telescopic antenna can slide in the stopper base. The antenna base of the antenna is disposed in the antenna jacket and connected, for example, hinged, to a lower part of the telescopic antenna. The antenna base can slide in the antenna jacket with the telescopic antenna. The antenna base has a ring-shaped protrusion, where an outer diameter of the ring-shaped protrusion is greater than the inner diameter of the stopper base. After the telescopic antenna is extended, the ring-shaped protrusion is clamped at the gap. In this way, when the antenna is drawn out for use, the ring-shaped protrusion can be clamped to the stopper base, thereby ensuring that the telescopic antenna does not fall off.

Specifically, the antenna jacket may be of a hollow cylindrical structure, or of a hollow square tube structure; and when the stopper base is disposed on the mobile terminal, the stopper base is coaxially disposed with the antenna jacket.

In addition, the stopper base is above the antenna jacket, and the gap exists between the stopper base and the antenna jacket in the length direction of the antenna jacket. To ensure that a position of the antenna packet is fixed, the antenna further includes an elastic sleeve, where the elastic sleeve is clamped at the gap between the stopper base and the antenna jacket, and the elastic sleeve is closely attached to a lower edge of the stopper base and an upper edge of the antenna jacket in a vertical direction of the antenna jacket, so as to restrict movement of the antenna jacket towards a direction of the stopper base.

Figure 4:
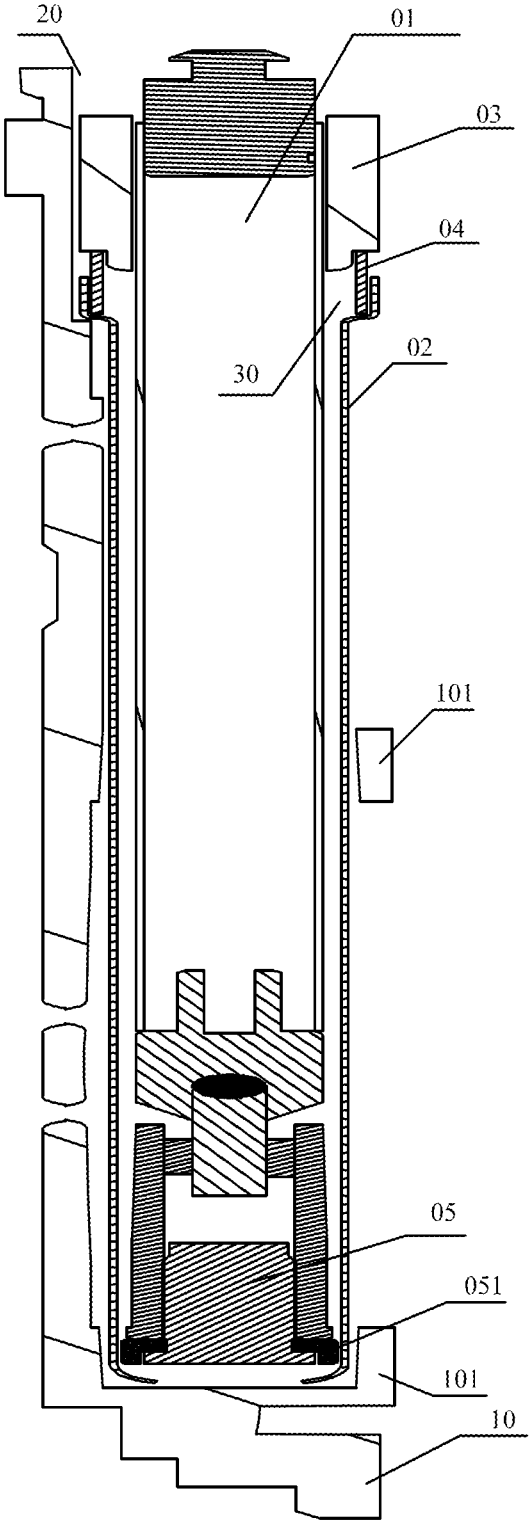
FIG. 4 is a sectional view of an antenna that is disposed on a mobile terminal according to Embodiment 1 of the present invention.

FIG. 4 is a sectional view of an antenna that is disposed on a mobile terminal according to Embodiment 1 of the present invention. As shown in FIG. 4, the telescopic antenna 01 is disposed in the stopper base 03 that is above the antenna jacket 02. The stopper base 03 is a hollow cylinder with certain thickness, and the stopper base 03 is coaxially disposed with the antenna jacket 02. The outer diameter of the telescopic antenna 01 adapts to the inner diameter of the stopper base 03, that is, the outer diameter of the telescopic antenna 01 is slightly less than the inner diameter of the stopper base 03, and the telescopic antenna 01 can slide in the stopper base 03.

When using the telescopic antenna, a user needs to draw out the telescopic antenna. To prevent the telescopic antenna from fully disengaging from the stopper base and prevent the telescopic antenna from retracting in the antenna jacket under an action of gravity after being drawn out, design is made at the bottom of the antenna base in the present invention.

Figure 5:
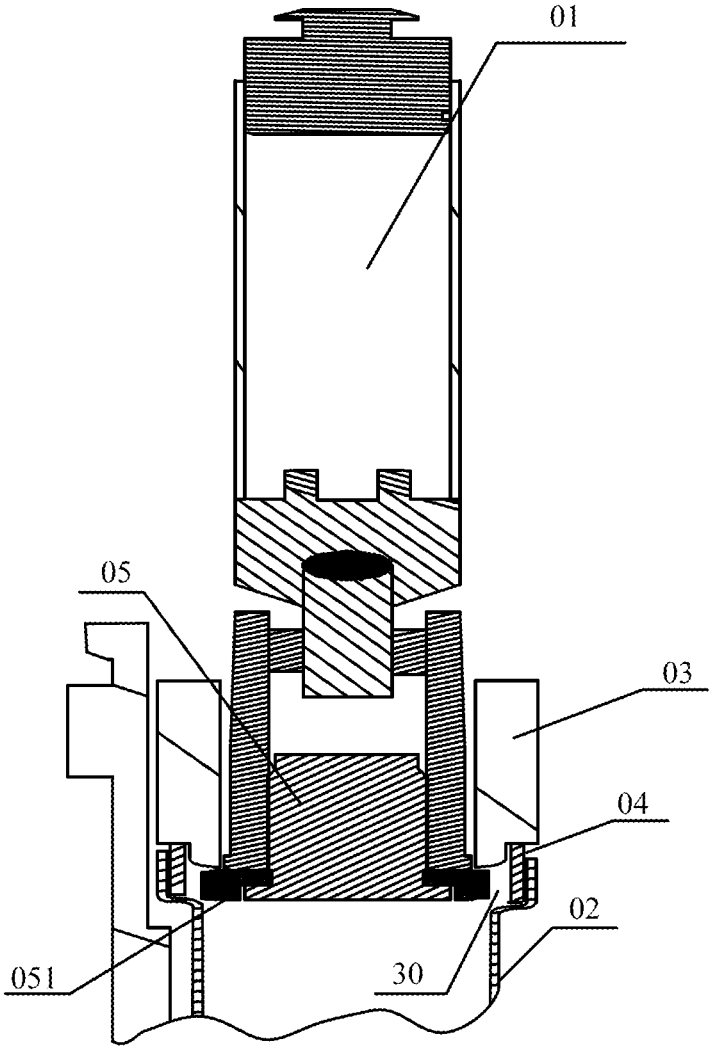
FIG. 5 is a schematic diagram of an antenna that is disposed on a mobile terminal and is extended according to Embodiment 1 of the present invention.

FIG. 5 is a schematic diagram of an antenna that is disposed on a mobile terminal and is extended according to Embodiment 1 of the present invention. As shown in FIG. 5, because the lower part of the telescopic antenna is connected, for example, hinged, to the antenna base 05, the antenna base 05 slides with the telescopic antenna 01. The ring-shaped protrusion 051 is designed on the antenna base 05, and a material of the ring-shaped protrusion 051 is an elastic plastic gasket with certain elasticity.

When the antenna base 05 is fully inside the antenna jacket 02, the ring-shaped protrusion 051 is subject to an extrusion force in a horizontal direction and is closely attached to an inner wall of the antenna jacket 02. When the telescopic antenna 01 needs to be used, the telescopic antenna 01 is drawn out, and the antenna base 05 moves with the telescopic antenna 01. A certain gap 30 exists under the stopper base 03 in the horizontal direction. When the ring-shaped protrusion 051 moves to the gap 30 under the stopper base 03, the ring-shaped protrusion 051 is no longer subject to the extrusion force of the inner wall of the antenna jacket 02 in the horizontal direction, and the ring-shaped protrusion 051 extends in the horizontal direction. In this case, an outer diameter of the ring-shaped protrusion 051 is greater than the inner diameter of the stopper base 03 and an inner diameter of the antenna jacket 02. Therefore, when the telescopic antenna 01 extends from the stopper base 03, the ring-shaped protrusion 051 is clamped with a lower part of the stopper base 03, thereby preventing the telescopic antenna 01 and the antenna base 05 from fully disengaging from the stopper base 03. In addition, the ring-shaped protrusion 051 is clamped at an upper part of the antenna jacket 02, thereby preventing the telescopic antenna 01 from retracting in the antenna jacket 02 under an action of gravity and affecting use of the user.

When the user stops using the telescopic antenna, the user gently exerts a downward force on the telescopic antenna, the ring-shaped protrusion 051 retracts in the horizontal direction under the force, and the telescopic antenna 01 retracts to the antenna jacket 02. The stopper base 03 above the antenna jacket 02 is fastened to the mobile phone housing 10, and the antenna jacket 02 is coaxially disposed with the stopper base 03. When the telescopic antenna is drawn out or retracts, the positioning limiting base 03 stabilizes the telescopic antenna on a sliding path in a vertical direction.

To improve stability of communication performance of the GPS antenna and the other antennas, the antenna jacket needs to be securely fastened to the mobile phone housing. Therefore, the antenna in Embodiment 1 of the present invention may further include an elastic sleeve. The elastic sleeve is clamped between the stopper base and the antenna jacket, so as to restrict movement of the antenna jacket towards a direction of the stopper base.

Refer to FIG. 3 and FIG. 4. The lower part of the antenna jacket 02 is closely attached to the mobile phone housing 10 in the vertical direction, and a ring-shaped elastic sleeve 04 is disposed between the stopper base 03 and the antenna jacket 02. Because of elasticity of the elastic sleeve 04 in the vertical direction, the antenna jacket 02 does not move upwards or downwards. In addition, a bump 101 extends from the mobile phone housing 10 in the groove 20 in which the antenna is placed, and the bump 101 can fasten the antenna jacket into the groove 20. Therefore, a surrounding metal environment of the GPS antenna and the other antennas is relatively stable, and communication performance of the GPS antenna and the other antennas is ensured.

Further, in Embodiment 1, the antenna jacket is not limited to a cylindrical shape. A disposition manner of the antenna jacket may be flexibly changed according to an actual requirement, that is, the antenna jacket may be of a tube structure with a side opening groove, such as a semi-cylindrical, a semi-arc tube, or a door-shaped tube structure.

In an actual application, use of the telescopic antenna may be flexibly changed according to a configuration of a mobile terminal on which the telescopic antenna is located, and positions of the telescopic antenna and a related accessory may also be adjusted.

Embodiment 2 of the present invention provides an antenna. Because of outline and accessory design of a mobile terminal, a side opening is provided at a position in which the antenna is disposed. Therefore, an antenna jacket may be designed to be of a semicylindrical structure, an antenna base of a telescopic antenna is disposed above the antenna jacket and fastened to an antenna housing, and the telescopic antenna extends from a side opening and an exposed part of the telescopic antenna can rotate outside the antenna jacket.

Figure 6:
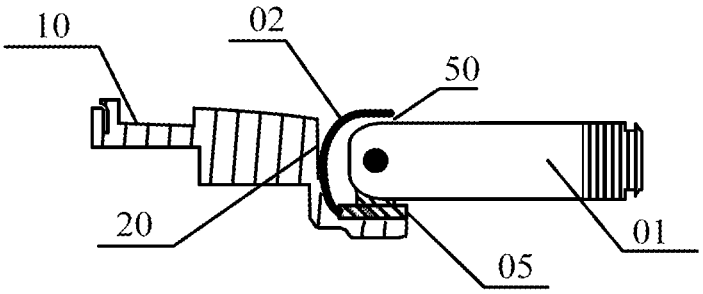
FIG. 6 is a schematic diagram of an antenna that is disposed on a mobile terminal according to Embodiment 2 of the present invention.

FIG. 6 is a schematic diagram of an antenna that is disposed on a mobile terminal according to Embodiment 2 of the present invention. As shown in FIG. 6, a semicircular groove is designed at a position in which the antenna is disposed on the mobile terminal. Correspondingly, an antenna jacket 02 is designed to be of a semicylindrical shape, an antenna base 05 of a telescopic antenna 01 is disposed above the antenna jacket 02, and the telescopic antenna extends from a side opening and an exposed part of the telescopic antenna can rotate outside the antenna jacket On the mobile terminal, the antenna jacket 02 is configured for the telescopic antenna 01. Therefore, when the telescopic antenna 02 extends from the side opening 50, a surrounding metal environment of other antennas, such as a GPS antenna, a Wi-Fi antenna, and a diversity antenna, which are disposed on a mobile phone housing 10 in an area adjacent to the antenna jacket 02 and/or attached to an outer wall of the antenna jacket 02 by using an antenna support, is relatively stable. Therefore, when the telescopic antenna 01 is extended, communication performance of the GPS antenna and the other antennas is not affected.

The antenna jacket in Embodiment 2 of the present invention may also be of a tube structure with a side opening. In an actual application, a shape and a disposition manner of the antenna jacket are not limited to the shape and disposition manner described in this embodiment of the present invention.

With reference to Embodiment 1 and Embodiment 2, Embodiment 3 of the present invention provides a combination antenna, and the combination antenna includes any one or a combination of several of the following antennas: a GPS antenna, a Wi-Fi antenna, and a diversity antenna. The combination antenna further includes the antenna characteristics provided in Embodiment 1 and Embodiment 2. As shown in FIG. 3, a GPS antenna 41 and a Wi-Fi antenna 42 are disposed in an area adjacent to an antenna jacket, and a diversity antenna 43 is attached to an outer wall of the antenna jacket by using an insulation support. In an actual application, any one or more antennas of the other antennas, such as the GPS antenna 41, the Wi-Fi antenna 42, and the diversity antenna 43, may be disposed in the area adjacent to the antenna jacket, or may also be attached to the outer wall of the antenna jacket by using the insulation support. In the combination antenna provided in Embodiment 3 of the present invention, a telescopic antenna and the other antennas, such as a GPS antenna, may be disposed together, without affecting a user's experience on communication performance of a mobile terminal.

With reference to Embodiment 3, Embodiment 4 of the present invention provides a mobile terminal. The mobile terminal includes the combination antenna in Embodiment 3, and the antenna is disposed in an antenna installation position on a terminal housing. Because the combination antenna in Embodiment 3 is used on the mobile terminal in Embodiment 4 of the present invention, communication performance of the mobile terminal is stable, thereby improving communication quality and meeting a user's requirement for performance of the mobile terminal.

According to an antenna, a combination antenna, and a mobile terminal provided in the embodiments of the present invention, because an antenna jacket is disposed outside a telescopic antenna, when the telescopic antenna is drawn out, the antenna jacket still stays in an original position and does not move. For a GPS antenna and other antennas, a surrounding metal environment does not significantly change, and the GPS antenna and the other antennas can work properly. Therefore, the GPS antenna and the other antennas do not need to be separated from the telescopic antenna to avoid impact on the GPS antenna and the other antennas when the telescopic antenna is drawn out. Therefore, the GPS antenna and the other antennas may be disposed on a mobile phone housing in an area adjacent to the telescopic antenna, or the GPS antenna and the other antennas may be placed on an antenna support if an insulation antenna support is disposed on the antenna jacket. The telescopic antenna can be disposed with the GPS antenna and the other antennas in a centralized manner, without compromising a user's optimal experience on performance of a mobile phone antenna. In addition, a size of the mobile terminal is smaller and the mobile terminal is easy to carry.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solutions described in the foregoing embodiments or make equivalent replacements to some technical features thereof; however, these modifications or replacements do not make the essence of the corresponding technical solutions depart from the scope of the technical solutions of the embodiments of the present invention.

What is claimed is:

1. An antenna comprising:

a telescopic antenna;

an antenna jacket, wherein the antenna jacket is of a hollow tube structure comprising an opening at at least one end, the telescopic antenna is disposed in the antenna jacket, and the telescopic antenna is configured to slide in the antenna jacket and extend from the opening at the one end of the antenna jacket;

a stopper base;

an antenna base, wherein the stopper base comprises a hollow tube structure, wherein the stopper base is disposed above the antenna jacket;

a gap between the stopper base and the antenna jacket in a length direction of the antenna jacket, wherein an inner diameter of the stopper base adapts to an outer diameter of the telescopic antenna; and wherein the antenna jacket is configured to be stationary relative to the antenna base, wherein the antenna base is disposed in the antenna jacket and connected to a lower part of the telescopic antenna, wherein the antenna base is configured to slide in the antenna jacket with the telescopic antenna, wherein the antenna base has a ring-shaped protrusion disposed within the hollow tube structure of the antenna jacket, wherein an outer diameter of the ring-shaped protrusion is greater than the inner diameter of the stopper base, wherein after the telescopic antenna is extended, the outer diameter of the ring-shaped protrusion is greater than the inner diameter of a lower part of the antenna jacket, wherein after the telescopic antenna is extended, the ring-shaped protrusion is clamped with a lower part of the stopper base and at an upper part of the antenna jacket, wherein a material of the ring-shaped protrusion comprises an elastic plastic gasket, and wherein at least one of a GPS antenna, a Wi-Fi antenna, or a diversity antenna is attached to an outer wall of the antenna jacket by an insulation support.

2. The antenna according to claim 1, wherein the telescopic antenna is configured to slide in the stopper base, wherein after the telescopic antenna is extended, the ring-shaped protrusion is clamped at the gap.

3. The antenna according to claim 2, wherein the antenna jacket is of a hollow cylindrical structure, and the stopper base and the antenna jacket are coaxially disposed.

4. The antenna according to claim 2, wherein the antenna further comprises an elastic sleeve, and the elastic sleeve is clamped at the gap between the stopper base and the antenna jacket, so as to restrict movement of the antenna jacket towards a direction of the stopper base.

5. The antenna according to claim 1, wherein the antenna jacket is of a semicylindrical structure, and the telescopic antenna extends from a side opening and an exposed part of the telescopic antenna is configured to rotate outside the antenna jacket.

6. The antenna according to claim 1, wherein the antenna jacket is of a tube structure with a side open slot, and the telescopic antenna is configured to rotate above the antenna jacket and extend from a side opening.

7. A combination antenna comprising any one or a combination of several of the following antennas:

a GPS antenna, a Wi-Fi antenna, and a diversity antenna, wherein the combination antenna further comprises a telescopic antenna, an antenna jacket, a stopper base, an antenna base, and a gap, wherein the antenna jacket is of a hollow tube structure comprising an opening at at least one end, the telescopic antenna is disposed in the antenna jacket, and the telescopic antenna is configured to slide in the antenna jacket and extend from the opening at the one end of the antenna jacket, wherein the stopper base comprises a hollow tube structure, wherein the stopper base is disposed above the antenna jacket, wherein the gap is between the stopper base and the antenna jacket in a length direction of the antenna jacket, wherein an inner diameter of the stopper base adapts to an outer diameter of the telescopic antenna, wherein the antenna jacket is configured to be fixed relative to the antenna base, wherein the antenna base is disposed in the antenna jacket and connected to a lower part of the telescopic antenna, wherein the antenna base is configured to slide in the antenna jacket with the telescopic antenna, wherein the antenna base has a ring-shaped protrusion disposed within the hollow tube structure of the antenna jacket, wherein an outer diameter of the ring-shaped protrusion is greater than the inner diameter of the stopper base, wherein after the telescopic antenna is extended, the outer diameter of the ring-shaped protrusion is greater than the inner diameter of a lower part of the antenna jacket, wherein after the telescopic antenna is extended, the ring-shaped protrusion is clamped with a lower part of the stopper base and at an upper part of the antenna jacket, wherein a material of the ring-shaped protrusion comprises an elastic plastic gasket; and any one or more antennas of the GPS antenna, the Wi-Fi antenna, and the diversity antenna of the combination antenna are attached to an outer wall of the antenna jacket by an insulation support.

8. The combination antenna according to claim 7, wherein the telescopic antenna is configured to slide in the stopper base, and wherein after the telescopic antenna is extended, the ring-shaped protrusion is clamped at the gap.

9. The combination antenna according to claim 8, wherein the antenna jacket is of a hollow cylindrical structure, and the stopper base and the antenna jacket are coaxially disposed.

10. The combination antenna according to claim 8, wherein the combination antenna further comprises an elastic sleeve, and the elastic sleeve is clamped at the gap between the stopper base and the antenna jacket, so as to restrict movement of the antenna jacket towards a direction of the stopper base.

11. The combination antenna according to claim 7, wherein the antenna jacket is of a semicylindrical structure, and the telescopic antenna extends from a side opening and an exposed part of the telescopic antenna is configured to rotate outside the antenna jacket.

12. The combination antenna according to claim 7, wherein the antenna jacket is of a tube structure with a side open slot, and the telescopic antenna is configured to rotate above the antenna jacket and extend from a side opening.

13. A mobile terminal comprising a combination antenna, the combination antenna comprising any one or a combination of several of the following antennas:

a GPS antenna, a Wi-Fi antenna, and a diversity antenna, wherein the combination antenna further comprises a telescopic antenna, an antenna jacket, a stopper base, an antenna base, and a gap, wherein the antenna jacket is of a hollow tube structure comprising an opening at at least one end, the telescopic antenna is disposed in the antenna jacket, and the telescopic antenna is configured to slide in the antenna jacket and extend from the opening at the one end of the antenna jacket, wherein the stopper base comprises a hollow tube structure, wherein the stopper base is disposed above the antenna jacket, wherein the gap is between the stopper base and the antenna jacket in a length direction of the antenna jacket, wherein an inner diameter of the stopper base adapts to an outer diameter of the telescopic antenna, wherein the antenna jacket is configured to be fixed relative to the antenna base, wherein the antenna base is disposed in the antenna jacket and connected to a lower part of the telescopic antenna, wherein the antenna base is configured to slide in the antenna jacket with the telescopic antenna, wherein the antenna base has a ring-shaped protrusion disposed within the hollow tube structure of the antenna jacket, wherein an outer diameter of the ring-shaped protrusion is greater than the inner diameter of the stopper base, wherein after the telescopic antenna is extended, the outer diameter of the ring-shaped protrusion is greater than the inner diameter of a lower part of the antenna jacket, wherein after the telescopic antenna is extended, the ring-shaped protrusion is clamped with a lower part of the stopper base and at an upper part of the antenna jacket, wherein a material of the ring-shaped protrusion comprises an elastic plastic gasket; and one or more of the GPS antenna, the Wi-Fi antenna, and the diversity antenna is attached to an outer wall of the antenna jacket by an insulation support.

14. The mobile terminal according to claim 13, wherein the telescopic antenna is configured to slide in the stopper base, wherein after the telescopic antenna is extended, the ring-shaped protrusion is clamped at the gap.

15. The mobile terminal according to claim 14, wherein the antenna jacket is of a hollow cylindrical structure, and the stopper base and the antenna jacket are coaxially disposed.

16. The mobile terminal according to claim 14, wherein the combination antenna further comprises an elastic sleeve, and the elastic sleeve is clamped at the gap between the stopper base and the antenna jacket, so as to restrict movement of the antenna jacket towards a direction of the stopper base.

17. The mobile terminal according to claim 13, wherein the antenna jacket is of a semicylindrical structure, and the telescopic antenna extends from a side opening and an exposed part of the telescopic antenna is configured to rotate outside the antenna jacket.

18. The mobile terminal according to claim 13, wherein the antenna jacket is of a tube structure with a side open slot, and the telescopic antenna is configured to rotate above the antenna jacket and extend from a side opening.

19. The mobile terminal according to claim 13, wherein the telescopic antenna is disposed in a groove of a mobile phone housing.

20. The antenna according to claim 1, wherein the telescopic antenna is disposed in a groove of a mobile phone housing.

* * * * *